United States Patent [19]

Borasci et al.

[11] Patent Number: 4,915,362

[45] Date of Patent: Apr. 10, 1990

[54] CARBON DIOXIDE SNOW NOZZLE FOR METALLURGY

[75] Inventors: Raymond Borasci, Chatenay Malabry, France; Jean-Michel Charles, Tokyo, Japan; Sylvain Windels, Aulnay-sous-Bois, France

[73] Assignee: Carboxyque Francaise and L'Air Liquide, Paris, France

[21] Appl. No.: 271,925

[22] Filed: Nov. 16, 1988

[30] Foreign Application Priority Data

Nov. 26, 1987 [FR] France ..... 87 16399

[51] Int. Cl.[4] ..... B05B 9/00

[52] U.S. Cl. ..... 266/266; 266/207

[58] Field of Search ..... 266/207, 266; 75/51.7

[56] References Cited

U.S. PATENT DOCUMENTS

| | | | |
|---|---|---|---|
| 2,953,305 | 9/1960 | Boudurant | 239/353 |
| 4,614,216 | 9/1986 | Savard | 164/67.1 |
| 4,666,511 | 5/1987 | Naud | 75/51.7 |
| 4,723,997 | 2/1988 | Lutgen | 266/207 |
| 4,781,122 | 11/1988 | Foulard et al. | 266/207 |

*Primary Examiner*—Robert McDowell

*Attorney, Agent, or Firm*—Curtis, Morris & Safford

[57] ABSTRACT

A carbon dioxide snow nozzle for in particular rendering a molten metal inert. The nozzle comprises a supply pipe supplying liquid carbon dioxide under pressure for connection to a source of liquid carbon dioxide under pressure, a T-shaped element having one end connected to the pipe and the other two ends connected to liquid carbon dioxide conveying line which each have and to a controlled valve the outlets of the valves being interconnected by a V-shaped connecting element which opens onto a pipe for discharging the snow.

16 Claims, 1 Drawing Sheet

CARBON DIOXIDE SNOW NOZZLE FOR METALLURGY

The present invention relates to a carbon dioxide snow nozzle for in particular rendering inert a molten metal such as steel when pouring from a first vessel into a second vessel, for the purpose of providing.a protection against oxidation and/or nitriding of the molten metal. It more particularly relates to a nozzle of utility when pouring steel from a converter or an electric furnace into a ladle, from a ladle into a distributor, or from a distributor into a continuous-casting ingot mould, etc.

At the beginning of a pouring of liquid steel, for example from a converter or furnace into a ladle or from a ladle into a distributor, or upon the first pouring from a ladle into this distributor in the case of sequence, the liquid metal is in contact with the atmosphere.

The height of the fall of the liquid metal into the receiving vessel and the turbulences result in rather large nitridation and/or oxidation reactions. These occur when pouring into a distributor generally up to the complete immersion of the nozzle in the poured liquid metal in the distributor, said nozzle being placed at the lower end of the ladle and surrounding the pouring jet. When the lower part of the nozzle is immersed, the problems of nitridation and/or oxidation are less important, since there are usually employed covering powders which are spread over the surface of the liquid metal in the distributor, or any other like known means. On the other hand, when pouring from a furnace or converter into a ladle, there are problems of oxidation and/or nitriding from the start to the end of the pouring.

Generally, when pouring from a ladle into a distributor, the aforementioned phenomenon of nitridation and/or oxidation usually lasts from 45 seconds to about 4 minutes, depending on the size and the shape of the distributor. The metal poured into the distributor before the immersion of the nozzle is consequently more or less oxidized and/or nitrided, and the steel billets or ingots formed from this metal do not have the desired metallurgical qualities.

Among the known processes for avoiding these drawbacks is the process known under the commercial name "SPAL" developed by the firm L'AIR LIQUIDE. The SPAL process employs cryogenic liquids such as liquid argon or nitrogen which very effectively protect the zone of impact of the metal jet by rendering the bottom of the vessel inert before the start of the pouring and thereafter covering the surface of the liquid metal to be protected during the pouring.

However, when it is desired to produce steels having a low percentage of nitrogen, i.e. when a nitridation of the steel is to be avoided, liquid nitrogen cannot be used for the protection of the molten metal. In this case, the sole process at present available resides in the use of liquid argon spread over the surface of the liquid metal. However, argon is a relatively expensive gas, and a more economical solution is sought which permits obtaining metallurgical results which are substantially identical to those afforded by the use of liquid argon.

The U.S. Pat. No. 4 614 216 of Savard et al. describes the protection of a pouring jet by means of gaseous carbon dioxide. But the use of gas has not been found to be very effective when it concerns projecting it into a ladle or a distributor for the purpose of providing a screen between the atmosphere and the molten metal, since the turbulences formed do not enable the ambient air to be eliminated.

The U.S. Pat. No. 4 666 511 of Naud describes a process for protecting against oxidation and/or nitriding a molten metal poured into a vessel, by the projection of carbon dioxide snow or dry ice into the vessel before the pouring and/or onto the bath of the molten metal in the course of the pouring. Liquid carbon dioxide is expanded through a valve so as to form the carbon dioxide snow. However, the solution proposed in this patent does not permit controlling and orienting the flow of carbon dioxide snow toward the foot of the pouring jet. This problem is particularly difficult to solve, since it concerns injecting the carbon dioxide snow in the vicinity of a molten metal which is at a temperature on the order of 1000° C. to 1500° C.

The French patent application No. 86/16475 filed on Nov. 26, 1986, describes a process for protecting a liquid metal against oxidation and/or nitriding , in particular by the injection of carbon dioxide snow or dry ice into the distributor or pouring box, the injection being carried out in two successive steps:

a first step for purging the distributor, occurring before the beginning of the pouring of the liquid metal in the course of which carbon dioxide snow is injected in accordance with a purging rate of flow so that said snow at least partly reaches the bottom of the distributor where it is at least partly sublimated so as to progressively expel the air present in the latter, this step being terminated when the concentration of oxygen in the vicinity of the zone corresponding to the foot of the liquid metal jet at the beginning of the pouring is less than about 0.5%, a second step for maintaining the atmosphere in the region of the foot of the jet, which starts when the liquid metal starts to flow into the distributor, in the course of which carbon dioxide snow is injected in accordance with a maintenance rate of flow which is lower than the purging rate of flow, so that the presence of this snow or the gas resulting from the sublimation of the latter, in a zone located in the vicinity of the foot of the jet and/or on the surface of the liquid metal in said distributor, maintains an atmosphere containing less than 0.5% by volume of oxygen in said zone, the pouring of the liquid steel starting substantially at the end of the first step and preferably at the end of the latter.

In a preferred manner of carrying out this process of the French patent application, in which the ladle is provided with a nozzle placed around its pouring orifice, the second step terminates as soon as the lower end of the nozzle is substantially immersed in the liquid metal, the surface of the bath of liquid metal in the distributor being then covered with means for protecting it against oxidation and/or nitriding, known per se. Preferably, the maintenance rate of flow is at the most equal to about 50% of the purging rate of flow.

According to one manner of carrying out the process described in said French patent application, there is injected into the ladle receiving the poured liquid steel coming from the converter or the electric furnace, before the start of this pouring, a quantity of snow which is sufficient to achieve a purging of said ladle, this quantity of carbon dioxide snow being preferably between 0.2 and 5 kg per metric ton of poured metal.

It will be understood that in a general way, the nozzle according to the present invention has applications in the pouring of a jet of liquid steel from a first vessel into a second vessel, the pouring jet and/or the surface of the bath of liquid metal of the second vessel being protected against oxidation and/or nitriding by carbon dioxide in the form of snow or dry ice.

Other applications in ladle metallurgy prescribe a protection of the surface of the bath of liquid metal against oxidation and/or nitriding by covering said surface with a layer of carbon dioxide snow.

All these applications require the use of a nozzle for injecting carbon dioxide snow which is easy to handle, reliable, can be used in a medium at high temperature and has a variable rate of flow.

However, it has been found that, when the liquid carbon dioxide is expanded to atmospheric pressure and in accordance with an adiabatic expansion to produce the snow, various problems are encountered:

if the rate of ejection of the gas-solid mixture is too low, the convection related to the temperature above the ladle is such that little or no snow reaches the bottom of the ladle or the surface of the liquid metal;

if the rate of ejection is too high, the convection in the vicinity of the nose of the nozzle is such that there is produced a mixture of solid and gaseous carbon dioxide which is such that air is entrained into the ladle and such that the quantity of snow in the ladle is very small bearing in mind the thermal exchange between the hot air and the snow.

The present invention solves the aforementioned problems.

The snow nozzle according to the invention comprises a pipe supplying liquid carbon dioxide under pressure and adapted to be connected to a source of liquid carbon dioxide under pressure, a T-shaped element having one end connected to said pipe and two other ends respectively connected in succession to at least one liquid carbon dioxide conveying line and to a controlled valve, the outlets of the controlled valves being interconnected by a V-shaped connecting element which opens onto a snow discharge pipe.

Preferably, the snow discharge pipe has in its upstream part a divergent portion having a frustoconical shape whose small base is located ajacent to the V-shaped connecting element and whose large base is located adjacent to the discharge opening at the end of the snow discharge pipe. This frustoconical element is preferably interchangeable and determines the rate of ejection of the carbon dioxide snow conveyed pneumatically by the carbon dioxide gas produced directly by the expansion. It moreover permits reducing a diphasic formation (gas/solid mixture), i.e. limiting the quantity of gas produced upon the expansion.

In practice, it has been found that this frustoconical element must not have, in most cases, a length of less than 300 mm. The apex angle of the corresponding cone will be preferably on the order of about 6° (between about 5° and 7° ).

Preferably, the rate of ejection of the gases and the solid particles will remain lower than or equal to 30 m/sec, while the rate of flow of snow will be between 40 kg/min and 150 kg/min.

Thus, when it is desired to reduce the rate of ejection of the gas/solid mixture with the same upstream pipe diameter, the length of the frustoconical element will merely be increased (beyond 300 mm) so as to increase the diameter of the downstream pipe.

According to a preferred manner of carrying out the invention, the conveying lines are rigid and/or bent at a radius on the order of 3 to 5 times their diameter.

Owing to its simplicity, the snow nozzle according to the invention may be installed directly under an electric furnace or under a converter or any system located in proximity to or above a pouring ladle.

A better understanding of the invention will be had from the following embodiments which are given by way of non-limitative examples with reference to the accompanying drawing in which.

Figures 1A, 1B, 2:
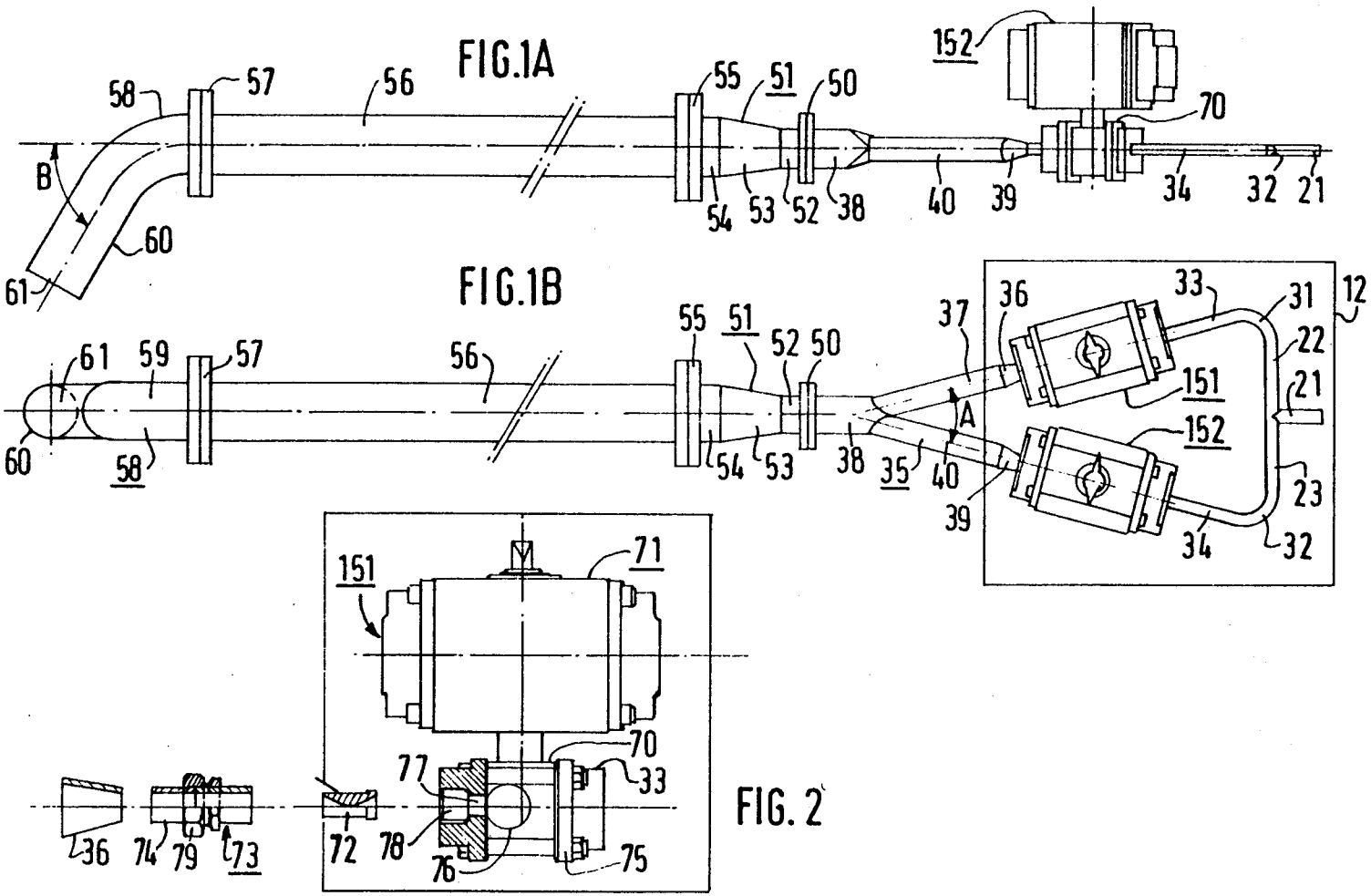
FIG. 1A is a side elevational view of an embodiment of a nozzle according to the invention.
FIG. 1B is a plan view of the nozzle shown in FIG. 1A.
FIG. 2 is a partly exploded view of an expansion valve employed in the nozzle shown in FIGS. 1A and 1B.

Liquid carbon dioxide stored in a reservoir (not shown) is supplied through a flexible supply pipe or hose (not shown) which provides the flexibility required for aiming the snow or dry ice produced by the nozzle. A T-shaped element is connected by its branch 21 to the hose and divides the liquid carbon dioxide into two parallel circuits in its branches 22 and 23 respectively. Each of the latter is extended by a rigid line comprising a curved portion 31, 32 whose radius is preferably between 3 and 5 times the diameter of the line so as to minimize pressure drops in this part of the nozzle, then by a rectilinear portion 33, 34. The branches 22, 23 and the portions 31, 32, 33, 34 of the rigid lines have a diameter slightly larger than the diameter of the branch 21 connected to the hose.

The rectilinear portions 33 and 34 of the rigid lines are respectively to connected means 151, 152 which form electrically-operated valve and will be described hereinafter with reference to FIG. 2. These means 151, 152 have their outlets connected to a V-shaped connecting element 35 which provides the conection between the two carbon dioxide snow outlets of the electrically operated valves. This element 35 therefore comprises two identical branches which each includes a divergent frustoconical element 36, 39 which has its small base located adjacent to the means 151, 152 and is extended by a cylindrical tube 37, 40 whose diameter is the same as the diameter of the large base of the frustoconical element, the two branches being united in a symmetrical manner to form a connecting end 38 whose section is slightly larger than or equal to the sum of the sections of the cylindrical tubes 37, 40. The angle A of convergence between the axes of the cylindrical tubes 37, 40 is minimized in accordance with the arrangement and the overall size of, in particular, the means 151 and 152 so as to avoid a loss of energy at the junction between the two streams, since this loss of energy produces a gaseous phase which is to be avoided.

The assembly 12 comprising the T-shaped element, the rigid lines, the electrically-operated valves 151, 152, and the V-shaped element 35 constitutes a standard unit forming means for producing carbon dioxide snow or dry ice which may be connected to optionally interchangeable means for projecting or spraying this snow. For this purpose, the downstream end (relative to the direction of flow of the snow) of the element 35 may be connected by a detachable flange 50 to an intermediate element 51 which determines, by its geometry, the rate of ejection of the carbon dioxide snow which is conveyed pneumatically by the gas directly produced by the expansion. This element 51 comprises, in succession in the downstream direction, a cylindrical portion 52 whose section is equal to the section of the downstream end of the element 35 and is detachably fixed to the element 35 by means of the flange 50, an intermediate frustoconical portion 53 whose length determines the rate of ejection of the snow and which is extended by a downstream cylindrical portion 54 (whose section is larger than the section of the portion 52) detachably connected by a flange 55 to the gun 56 proper. The gun 56 is a cylindrical tube whose section is identical to the section of the portion 54, the inside diameter of this section depending on the desired rate of ejection of the solid/gas mixture for a given diameter of pipe 52 which is a function of the desired maximum rate of flow of the nozzle.

The whole of the proposed equipment, irrespective of its length, is so dimensioned that the outlet velocity of the particles of snow is such that the jet has the required kinetic energy for projecting or spraying the carbon dioxide snow at the desired region and avoiding disturbing air aspiration phenomena which would result in an untimely sublimation of a part of the solid particles produced and have an adverse effect on the efficiency of the installation.

The gun 56 is connected by means of the detachable flange 57 to a consumable end piece or nose 58 comprising a bent upstream cylindrical portion 59 connected to the flange 57 and a downstream cylindrical portion 60 which is substantially rectilinear and whose axis makes an angle B of about 60° with the axis of the gun 56 in the presently-described embodiment. This consumable end element 58 may have any desired shape: it may have a straight cylindrical shape, a bent shape, a diameter which is identical to or larger than the diameter of the gun, a divergent and optionally bent frustoconical shape, etc., so as to be correctly aimed at a precise region (foot of the jet: cylindrical element) or a larger surface (divergent frustoconical element for the total area of a ladle). The mobility of the flange 57 is previously determined in accordance with the conditions of use or may be controlled mechanically, electrically, or by any other device.

FIG. 2 is a partly exploded view of the electrically-operated valve 151, the valve 152 being similar in which the details of valve 7 have not been shown. The electro-pneumatic control of this valve 70 is achieved for example by means of a WORDCHESTER TM control device provided with a pneumatic operator which controls the movement of the closure member (not shown) of the valve 70 connected to the rigid pipe 33 by a flange 75. The ball closure member system known per se, of the cryogenic valve 70 is shown schematically at 76 and is located adjacent a bore 77. The bore 77 is extended by a bore 78 having a diameter larger than the diameter of the bore 77, in which bore 78 is disposed an injector 72 which limits the flow of liquid carbon dioxide to be conveyed. This injector abuts against the inner end of the bore 78, and its upstream end face is located close to the closure member of the valve (bore 77 of short length) so as to avoid any untimely formation of snow between the injector 72 and the closure member (not shown). The internal structure of the injector 72 is that of a venturi device with a convergent upstream part, a central part of constant diameter, and a divergent downstream part. The downstream end face of injector 72 abuts against the connecting device 73 which caps the injector and is screwed into the bore 78 which is tapped. A flange 79 for connecting the divergent frustoconical part 36 is placed at one of the upstream ends of the V-shaped element 35.

The whole of the equipment described hereinbefore is so dimensioned as to provide an optimum efficiency of the conversion of the liquid carbon dioxide into a solid/gas mixture bearing in mind, on one hand, the thermodynamic conditions of storage of the liquid carbon dioxide, since the pressure of the liquid carbon dioxide reservoir is controlled in a mini/maxi range of pressure which is as small as possible, thereby avoiding fluctuations in the flow due to possible fluctuations in the pressure, and, on the other hand, the specific insulation characteristics of the installation so as to avoid any entry of heat and consequently limit the diphasic rate, i.e. snow/carbon dioxide gas mixture (improved control of the flow).

The foregoing criteria therefore determine the flow of liquid carbon dioxide through the injector which is itself designed for a given pressure and for 100% of liquid.

As a non-limitative example, there will be given hereinafter the characteristics of a nozzle which permits successfully carrying out the process described in the aforementioned French patent application.

This nozzle is so dimensioned as to provide a flow of solid carbon dioxide corresponding to the conversion of 120 kg/min of liquid carbon dioxide by the use of an injector 72 having a diameter of 10 mm in the unit 151 and an injector 72 having a diameter of 12 mm in the unit 152.

The nozzle therefore provides three possible rates of flow:

When the valve 151 alone is opened, the injector having a diameter of 10 mm is used alone. The flow is then 80 kg/min of liquid carbon dioxide.

When the valve 152 alone is opened, only the injector having a diameter of 12 mm is used. The flow of liquid carbon dioxide is then 105 kg/min.

When both valves are opened simultaneously, the two injectors are used and the flow of liquid carbon dioxide is 120 kg/min.

The liquid carbon dioxide is stored at a pressure of 20 bars and a temperature of about −20° C.

Between the liquid carbon dioxide storage means and the T-shaped element, there is employed, in the presently-described embodiment, a supply hose having a diameter of 2.54 cm (1 inch) and a length of 30 m which results in a pressure drop of 5 bars.

For a flow of 120 kg/min (two injectors employed simultaneously) of liquid carbon dioxide, the volumne of gas to be discharged is about 40%, namely 30 cu.m/min =0.5 cu.m/sec.

The outlet diameter of the nozzle at the downstream cylindrical portion 60 is 150 mm and the velocity of the issuing gases is 30 m/sec.

For a flow of 80 kg/min (one injector having a diameter of 10 mm being used), the volume of gas to be discharged is 0.32 cu.m/sec. With an outlet diameter of the nozzle of 150 mm, this produces an outlet velocity of the gases of 19 m/sec.

The nozzle for rendering a distributor or pouring box inert is used in accordance with the process described in the aforementioned French patent application. This nozzle thus permits in particular the use of the double flow taught in said French patent application.

Cases may arise in which the user needs a low jet energy for rendering a metallurgical vessel inert in which the thermal effects, the capacity, the surface area/volume ratio are very different from the pouring between a furnace and a ladle or a converter and a ladle.

A more homogeneous distribution of the solid carbon dioxide is then essential. This may be the case when rendering inert the surface of a ladle in the course of treatment or of an induction furnace, etc.

In this case, an injector is preferably employed which has two opposed calibrated orifices at 180° and disposed tangentially to the wall of the tube of th element 73 in which it is disposed, in order to cause a rotation of the combined gas and solid (the axially downstream end of the injector 72 is then closed and replaced by two divergent frustoconical openings whose axes are oriented tangentially relative to the wall of the tube). The velocity obtained is sufficient to avoid the adherance of the particles to the wall of the tube 56 of the gun.

Furthermore, this rotation of the particles permits a more rapid reduction of the kinetic energy of the jet by increasing the pressure drops.

At the outlet of the gun, the rotating solid particles are distributed in the form of a cone which thus results in a more homogeneous distribution of the snow at the bottom of for example a distributor or pouring box.

We claim:

1. A carbon dioxide snow nozzle for rendering a molten metal inert, said nozzle comprising a T-shaped element having a first end for connection to a source of liquid carbon dioxide and a second end and a third end, a first liquid carbon dioxide conveying line having a first controlled valve with a first outlet and connected to said second end of the T-shaped element, a second liquid carbon dioxide conveying line having a second controlled valve with a second outlet and connected to said third end of the T-shaped element, a V-shaped connecting element having a first branch and a second branch respectively connected to said outlets of the valves and an outlet end, and a snow discharge pipe connected to said outlet end of the V-shaped element.

2. A carbon dioxide snow nozzle for rendering a molten metal inert, according to claim 1, wherein the conveying lines are rigid.

3. A carbon dioxide snow nozzle for rendering a molten metal inert, according to claim 1, wherein each of the conveying lines comprises a bent portion having a radius of curvature three to five times the diameter of the conveying line.

4. A carbon dioxide snow nozzle for rendering a molten metal inert, according to claim 1, wherein each of the valves defines a direct passage therethrough.

5. A carbon dioxide snow nozzle for in particular rendering a molten metal inert, according to claim 1, further comprising a respective electro-pneumatic operating device associated with each valve for controlling the valve.

6. A carbon dioxide snow nozzle for rendering a molten metal inert, according to claim 1, wherein each branch of the V-shaped element includes relative to flow therethrough a divergent end portion followed by a portion having a constant section.

7. A carbon dioxide snow nozzle for rendering a molten metal inert, according to claim 1, wherein the valves each comprise an injector for limiting the flow of liquid carbon dioxide therethrough.

8. A carbon dioxide snow nozzle for rendering a molten metal inert, according to claim 7, wherein the valves each comprise a pivotal ball and the injector is placed in proximity to said ball.

9. A carbon dioxide snow nozzle for rendering a molten metal inert, according to claim 7, wherein the injector comprises a venturi device.

10. A carbon dioxide snow nozzle for rendering a molten metal inert, according to claim 7, comprising an element which is divergent relative to flow therethrough and connects the injector to the respective branch of the V-shaped element.

11. A carbon dioxide snow nozzle for rendering a molten metal inert, according to claim 1, comprising at the downstream end of the nozzle relative to flow therethrough a consumable and interchangeable member.

12. A carbon dioxide snow nozzle for rendering a molten metal inert, according to claim 11, wherein said member is adjustable in position.

13. A carbon dioxide snow nozzle for rendering a molten metal inert, said nozzle comprising a T-shaped element having a first end for connection to a source of liquid carbon dioxide and a second end and a third end, a first liquid carbon dioxide conveying line having a first controlled valve with a first outlet and connected to said second end of the T-shaped element, a V-shaped connecting element having a first branch and a second branch respectively connected to said outlets of the valves and an outlet end, and a snow discharge pipe connected to said outlet end of the V-shaped element, the snow discharge pipe having a discharge opening at a downstream end of the snow discharge pipe relative to flow through the discharge pipe and a frustoconical divergent portion flow therethrough, the frustoconical divergent portion having a small base located adjacent to the V-shaped connecting element and a large base located adjacent to the discharge opening of the snow discharge pipe.

14. A carbon dioxide snow nozzle for rendering a molten metal inert, according to claim 13, wherein the frustoconical divergent portion is an intermediate element and said small base has an inlet cross-inlet cross-section which is at least equal to the sum of the sections of the branches of the V-shaped element.

15. A carbon dioxide snow nozzle for rendering a molten metal inert, according to claim 14, wherein the intermediate element is detachable.

16. A carbon dioxide snow nozzle for rendering a molten metal inert, according to claim 14, wherein the length of the intermediate element is variable.

* * * * *

UNITED STATES PATENT AND TRADEMARK OFFICE

CERTIFICATE OF CORRECTION

PATENT NO. : 4,915,362

DATED : April 10, 1990

INVENTOR(S) : Raymond Borasci et al.

It is certified that error appears in the above-identified patent and that said Letters Patent is hereby corrected as shown below:

Claim 5, column 7, line 50, delete "in particular".

Claim 14, column 8, line 48, after "inlet" delete "cross-inlet";

line 49, before "sections" insert --inlet cross- —.

Signed and Sealed this

Ninth Day of July, 1991

*Attest:*

HARRY F. MANBECK, JR.

*Attesting Officer*

*Commissioner of Patents and Trademarks*